US005716460A

United States Patent [19]

Manning et al.

[11] Patent Number: 5,716,460

[45] Date of Patent: Feb. 10, 1998

[54] METHODS FOR MAKING MAGNETIC STRIPS

[75] Inventors: Neil R. Manning; Richard L. Anderson, both of Marengo, Ill.

[73] Assignee: The Arnold Engineering Company, Marengo, Ill.

[21] Appl. No.: 646,986

[22] Filed: May 8, 1996

[51] Int. Cl.[6] ..... H01F 1/147

[52] U.S. Cl. ..... 148/120; 148/121

[58] Field of Search ..... 148/120, 121, 148/122, 101, 102

[56] References Cited

U.S. PATENT DOCUMENTS

| | | | |
|---|---|---|---|
| 1,975,746 | 10/1934 | Hall | 148/21.5 |
| 3,301,720 | 1/1967 | Griest, Jr. | 148/120 |
| 3,769,100 | 10/1973 | Watanabe et al. | 148/126 |
| 3,783,041 | 1/1974 | Tokushima | 148/120 |
| 3,953,252 | 4/1976 | Levin et al. | 148/121 |
| 4,475,961 | 10/1984 | Jin | 148/31.55 |
| 4,510,489 | 4/1985 | Anderson, III et al. | 340/572 |
| 4,623,877 | 11/1986 | Buckens | 340/572 |
| 5,146,204 | 9/1992 | Zhou et al. | 340/551 |
| 5,225,807 | 7/1993 | Zhou et al. | 340/551 |
| 5,313,192 | 5/1994 | Ho et al. | 340/551 |
| 5,351,033 | 9/1994 | Liu et al. | 340/572 |
| 5,431,746 | 7/1995 | Manning et al. | 148/122 |
| 5,527,399 | 6/1996 | Manning et al. | 148/120 |

FOREIGN PATENT DOCUMENTS

| | | | |
|---|---|---|---|
| 46-42301 | 12/1971 | Japan | 148/120 |
| 1369509 | 10/1974 | United Kingdom . | |

OTHER PUBLICATIONS

Fedash, G.M., "Study of Coercivity of Cold-Worked and Annealed Iron Alloys", *The Physics of Metals and Metallography* 1957, 4(2), pp. 50–55.

Bozorth, R., ed., "Ferromagnetism", D. Van Nostrand Company, Inc., New York, 1951, pp. 234–236; 418–419.

Hansen, M. ed., "Constitution of Binary Alloys", McGraw-Hill Book Co., New York, 1958, pp. 664–667.

*Primary Examiner*—John Sheehan

*Attorney, Agent, or Firm*—Woodcock Washburn Kurtz Mackiewicz & Norris LLP

[57] ABSTRACT

Methods for preparing magnetic strips are provided in which the strips are manufactured to a thickness of less than about 0.005 inches and are made of a iron-based alloy having a manganese content of from about 8 to about 18 weight percent. The thin strips can be prepared by annealing the alloy, then cold rolling the alloy to reduce its thickness by at least about 40% to produce an initial strip, thermally treating the initial strip between about 400° C. and its austenitizing temperature, cold rolling the initial strip to reduce its thickness by at least 75% to below about 0.005 inches, and thermally treating this strip at a temperature of at least 525° C. for a period of time between about 0.1 and about 3 minutes. The strips are particularly useful in electronic article surveillance systems.

12 Claims, 1 Drawing Sheet

METHODS FOR MAKING MAGNETIC STRIPS

FIELD OF THE INVENTION

The present invention relates to processes for preparing permanent magnetic strips. More particularly the invention relates to relatively thin magnetic strips, those having a thickness of below about 0.005 inches. The strips are advantageously employed as components in markers or tags for use in electronic article surveillance (EAS) systems, and thus the present invention is related to improved magnetic markers and to methods, apparatus, and systems for using such markers.

BACKGROUND OF THE INVENTION

Certain metallic alloy compositions are known for their magnetic properties. Various applications exist for the use of such alloys within industry. The rapidly expanding use of such alloys has also extended into such markets as electronic article surveillance (EAS) systems. Many of these newer markets require alloys with superior magnetic properties at reduced costs such that the items within which they are employed can be discarded subsequent to their use.

EAS systems can be operated with markers as described in U.S. Pat. Nos. 4,510,489, 4,623,877, 5,146,204, 5,225,807, 5,313,192, and 5,351,033, among others. These markers generally contain, as the operative control means within the marker itself, a semi-hard magnetic element and a soft magnetic element. The semi-hard magnetic element as described by the present invention is a component having a coercivity in the range of about 10–200 Oersteds and a remanence, determined after the element is subjected to a DC magnetization field that magnetizes the element substantially to saturation, of about 7–13 kilogauss.

In the tag of the U.S. Pat. No. 4,510,489 patent, a semi-hard magnetic element is placed adjacent to a magnetostrictive amorphous element. By magnetizing the semi-hard magnetic element substantially to saturation, the resultant magnetic flux of the magnetic element arms or activates the magnetostrictive element so that it can mechanically resonate or vibrate at a predetermined frequency in response to an interrogating magnetic field.

The mechanical vibration results in the magnetostrictive element generating an electromagnetic signal at a predetermined frequency. The generated signal can then be sensed to detect the presence of the tag. By demagnetizing the semi-hard magnetic element, the magnetostrictive element is disarmed or deactivated so that it can no longer mechanically resonate at a defined frequency.

The metallic alloy compositions that constitute permanent magnets are characterized by various performance properties such as coercive force, $H_c$, and residual induction, $B_r$. The coercive force is a measure of the resistance of the magnet to demagnetization and the residual induction is a measure of the level of induction possessed by a magnet after saturation and removal of the magnetic field. Superior magnetic properties can be obtained by using a ferrous alloy containing chromium and cobalt. However, the presence of cobalt typically makes such alloys prohibitively expensive and thus impractical in various end uses, such as elements in markers used in EAS systems.

Certain of the newer magnetic markets further require the preparation of the alloy into a relatively thin strip of material such that the magnetic properties are provided in an economical fashion. As the demand for increasingly thin magnetic strips increases, the selection of metallic alloys possessing the required magnetic properties while also possessing the necessary machinability and workability characteristics to provide the desired shapes, becomes exceedingly difficult. For example, ferrous alloys having carbon contents of about 1 weight percent and chromium contents of about 3–5 weight percent have been shown to exhibit advantageous magnetic properties. However, these alloys are mechanically hard and cannot be rolled easily to the required thickness due to either initial hardness or high levels of work hardening during processing.

Practical solutions to the problems outlined above have been developed by the present inventors, as set forth in U.S. Pat. No. 5,431,746, which is incorporated herein in its entirety. This patent describes processes for preparing thin magnetic strips by rolling a low carbon iron-based alloy to the proper thickness and then subjecting the strip to a carburization process to yield the final magnetic properties. A further solution was developed by the present inventors, as set forth in allowed application Ser. No. 08/394,705, filed Feb. 27, 1995, which is incorporated herein in its entirety, where such thin magnetic strips are prepared with an alloy containing a specified carbon content and wherein the carbon is present in the form of spheroidal carbides within the iron-based matrix. Although these inventive methods provide practical solutions to the problem of preparing such thin magnetic strips, processing simplification is always an area of continued research.

A need therefore exists in the permanent magnet art, and particularly in the EAS systems art, for processing techniques to prepare thin magnetic strips having superior magnetic properties without the need for cobalt and other expensive components in the alloy compositions constituting the magnetic strip. Preferred alloy compositions should also have a relatively low concentration of carbon, which has been shown to present difficulties during the thickness reduction processing of the strip material. Thus, the magnetic strips should be made from alloy compositions which are amenable to processing of the alloy into the thin strips required by many industrial uses, especially those below about 0.005 inches in thickness.

SUMMARY OF THE INVENTION

The present invention provides methods for preparing magnetic strips and also magnetic strips that can be produced by those methods. The magnetic strips can be prepared having a thickness of less than about 0.005 inches, preferably less than about 0.003 inches, and more preferably less than about 0.002 inches. The magnetic strips can also be prepared without the need for cobalt or carbon in the alloy, while still providing superior magnetic properties, such that economical products result.

In accordance with a preferred embodiment, methods are set forth in which an iron-based alloy, containing primarily iron and manganese, is processed into a thin magnetic strip having a thickness below about 0.005 inches. The iron-based alloy contains between about 8 and about 18 weight percent manganese as the primary alloying element. Iron comprises essentially the balance of the iron-based alloy and is present in an amount of at least 80 weight percent. Combined, the iron and manganese constitute at least about 90 weight percent of the iron-based alloy.

The iron-based alloy is preferably processed, using conventional techniques, such as hot forging, hot rolling, pickling, and/or grinding, and cold rolling to form a strip having a thickness in the range of about 0.03 to about 0.06 inches. This iron-based alloy strip is then annealed by heating the strip to a temperature of at least about 800° C. and preferably for a period of time to distribute the manganese throughout the iron-based alloy.

The annealed strip is then cold rolled to reduce its thickness by at least 50 percent. This strip material is then subjected to a decomposition heat treatment step during which the strip material is heated to a temperature of at least about 400° C. and below the austenitizing temperature of the alloy. The strip material is heated at this temperature for at least about 30 minutes, and preferably between about 8 and about 24 hours. The strip material is then subjected to a second cold rolling step to reduce its thickness by at least 75 percent resulting in the strip material having a final thickness of below about 0.005 inches.

The as-produced strip material at this point in the processing does not possess the requisite magnetic properties desired for most semi-hard magnetic uses. The present invention provides for superior processing techniques to achieve the final magnetic properties. In accordance with the present invention this strip material is thermally treated at a temperature of at least 525° C. for a period of time of less than 3 minutes. The speed at which this final processing step has been found to be effectively conducted results in diminished processing costs. This final thermal treatment step is preferably conducted by transporting the strip material through a hot zone within a strip furnace. The hot zone is preferably maintained at a temperature of between 525° C. and 600° C. and the residence time of the strip material as it passes through the hot zone is from about 0.1 to about 3 minutes.

The final, thin strip material has developed magnetic properties such that its coercivity, $H_c$, is at least about 20 Oersteds and its remanence, $B_r$, is at least 8,000 gauss. The strip material also develops a high degree of squareness (Br/Bs), which is desirable in electronic article surveillance (EAS) systems because such materials supply a constant flux and the EAS target can be more definitively activated and deactivated.

DETAILED DESCRIPTION OF PREFERRED EMBODIMENTS

Figure 1:
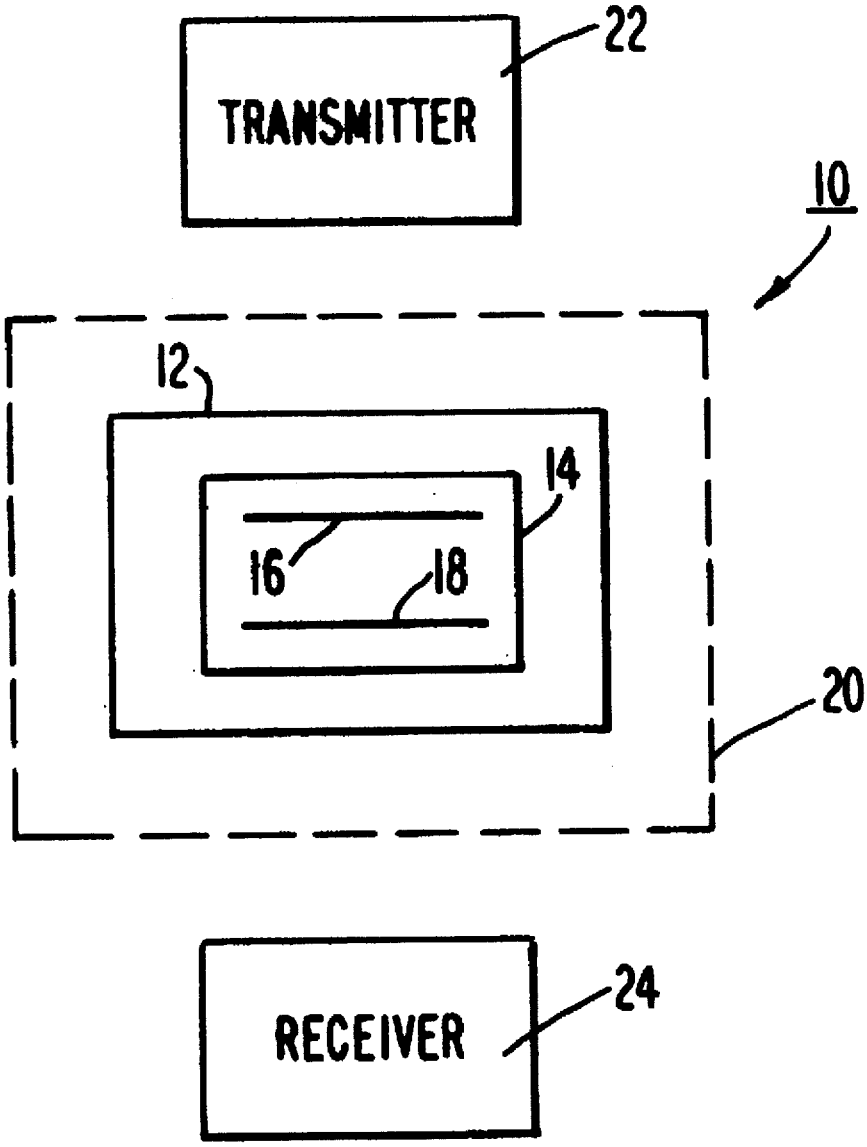
FIG. 1 is a representation of an EAS system using a marker including a semi-hard magnetic element as described in the present invention.

The present invention provides processes for preparing relatively thin magnetic strips of ferrous alloy materials. The magnetic strips have a thickness of less than about 0.005, preferably less than about 0.003, more preferably less than about 0.002, inches. The thin magnetic strips are useful in such applications as protection devices in merchandise retailing. As such the thinness of the strips provides clear cost advantages to thicker strip materials. It is necessary, however, that the thin strips of the present invention can be cut into individual final products without breaking, thus the final strip material must not be too brittle.

The base alloy to be used in the processes of the present invention is an iron-based alloy. This alloy contains manganese as the primary alloying metal. The manganese content of the alloy is between about 8 and 18. The iron preferably constitutes the remainder of the alloy, except for impurity levels of other metals. Generally, the iron content of the alloy is at least about 80, preferably at least about 85, and more preferably from about 85 to about 90, weight percent of the alloy. The iron-based alloy is preferably constituted by iron and manganese, and together those metals comprise at least 90, preferably at least 95, and more preferably at least 98, weight percent of the alloy.

The iron-based alloy can also contain other metals as alloying elements. For instance, the alloy can contain titanium in amounts up to about 5% wt., molybdenum in amounts up to about 2% wt., chromium in amounts up to about 3% wt., vanadium in amounts up to about 2% wt., and cobalt in amounts up to about 2% wt. Other elemental metals can be present in impurity levels of preferably less than about 1% wt. total, and these metals include Cu, Zn, Al, Ni, Si, Hf, W, and Zr. The carbon content of the alloy used to prepare the strips of the present invention should be below about 0.1% wt, preferably below 0.07% wt., and more preferably below 0.05% wt. As can be appreciated, the overall magnetic and physical properties of the final strip material can be enhanced by minimizing the level of impurities. Thus, it is preferred that the ingot used to form the iron-based alloy be prepared by means of a vacuum melting process or melting the alloy under a protective slag cover.

The magnetic properties of the thin magnetic strips have been found to be dependent on the processing technique employed to reduce the thickness of the iron-based alloy from its thickness at its final full austenitic anneal down to the 0.001–0.005 inch range. The methods of the present invention provide for the economical processing of the alloy, thereby reducing production costs.

Typically, the iron-based alloy can be produced as a forged plate having a thickness of greater than about 0.1 inches. This plate can be reduced to a thickness of from about 0.03 to about 0.06 inches by conventional techniques such as cold rolling, etc. The processing steps associated with reducing the iron-based alloy to this thickness are not considered to be a part of the present invention.

The iron-based alloy, having a thickness of from about 0.03 to about 0.06 inches, is fully annealed at a temperature within the austenite region, typically at least about 800° C., preferably at least about 850° C., and more preferably in the range of from about 900° C. to about 1025° C. The alloy material is typically held at this temperature for about 0.5–2 hours. This step allows the alloy to fully homogenize. The alloy is then cooled to room temperature by any means such as exposure to ambient conditions or quenching in a helium gas. In one embodiment, the alloy is cooled rapidly to 1280° F. then cooled 50° F./hr until a temperature of about 750° F. is reached, and thereafter cooled by any means at any rate.

This annealed, iron-based alloy is then cold rolled to reduce the thickness of the material. The thickness is reduced by at least 40%, preferably at least 45%, and more preferably at least 50%, during this rolling step. This rolling step results in grain elongation. The grains within the microstructure of the alloy elongate during this rolling step and the ratio of surface area to volume of the grains thus increases.

The initially reduced alloy material is then thermally treated at a temperature above about 400° C. and below the austenitizing temperature of the iron-based alloy. Preferred processing temperatures range from about 400° C. to about 600° C., and the material is generally held at that temperature for at least about 1 hour, preferably from about 8 to about 24 hours, and more preferably from about 12 to about 18 hours. This thermal decomposition step is conducted to achieve phase decomposition of the alloy.

The thermally treated strip material is then subjected to another cold rolling processing step. The thickness of the strip material is reduced at least 75%, preferably at least 80%, more preferably at least 85%, and even more preferably at least 90%, during this rolling step. The resulting strip has a thickness below about 0.005 inches, preferably below about 0.003 inches, and more preferably below about 0.002 inches. Generally, the thickness of most strips used for common semi-hard magnetic applications is between about 0.001 and 0.005 inches. This rolling step develops the structure of the iron-based alloy for enhancing the magnetics of the alloy by again elongating the grains. The second cold rolling step will again cause dislocations to accumulate in the structure of the strip material. These dislocations result in the strip material being brittle and unacceptable for most uses.

A final thermal treatment is then conducted on the strip material to both relax the structure of the material and to increase the magnetic properties of the strip material. The squareness, that is, the ratio of the remanence, $B_r$, to the saturation induction, $B_s$, increases during this final thermal treatment. The squareness of the strip material is at least about 0.8, and generally in the range of from about 0.8 to about 0.97, more preferably about 0.85 to about 0.95. It has been found that the coercivity and the squareness of the material increase with an increase in the final thermal treatment temperature for a given manganese content, while the remanence remains relatively constant up to a coercivity level of about 55 Oersteds and thereafter the remanence drops off slightly.

The final thermal treatment is conducted for less than about 3 minutes, preferably for about 0.1 to about 3 minutes, and more preferably from about 0.25 to about 2 minutes at a temperature of from at least about 525° C. and up to about 625° C., more preferably from about 535° C. to about 600° C. In the preferred embodiment of the present invention, the final thermal treatment step is conducted within a continuous strip heat treating furnace. The strip furnace is constructed with a heated zone, or hot zone, that is maintained at the treatment temperature of between about 525° C.–625° C. The thin strip material is transferred through the furnace and the strip material is fed through the hot zone at a rate such that the residence time within the hot zone is between about 0.1 and about 3 minutes.

The thin magnetic strips of the present invention are processed in such a way that the final strip material possesses superior semi-hard magnetic properties. The final strip material can be described as either a low coercivity material or a high coercivity material. The low coercivity material has a coercivity, $H_c$, below about 40 Oersted, and generally in the range of from about 20 to about 40, more commonly between about 20 and about 30, Oersted; the low coercivity material typically having a lower manganese content of from about 8 to about 12, and more preferably from about 10 to about 12, percent by weight. The high coercivity materials have a coercivity of at least about 40 Oersted, and generally in the range of from about 45–80, more preferably from about 50–70, Oersteds; the high coercivity material typically having a higher manganese content of from about 12 to about 15, and more preferably from about 12 to about 14, percent by weight.

For both the low and the high coercivity materials, the thin magnetic strips have a remanence, $B_r$, of at least about 8,000 gauss, and commonly in the range of from about 8,000 to about 14,000 gauss. Generally, the remanence is at least 9,000, preferably at least about 10,000, and more preferably at least about 10,500 gauss.

The magnetic strips of the present invention are useful in such applications as protection devices in merchandise retailing. As such the thinness of the strips provides clear cost advantages to thicker strip materials. It is necessary, however, that the thin strips of the present invention can be slit into individual final products without breaking, thus the final strip material must not be too brittle.

The magnetic strips of the present invention are particularly suited for use as control elements for markers or tags in magnetic electronic article surveillance (EAS) systems. The preparation of such magnetic markers and their use in EAS control systems are well known in the art, and are shown, for example, in U.S. Pat. Nos. 4,510,489, 5,313,192, and 5,351,033, all of which are incorporated herein in their entireties. Generally, the EAS system operates as shown in FIG. 1, wherein an EAS system 10 is configured to have an article 12 in a detection zone 20. A marker 14 is disposed on the article 12. The marker 14 has at least two elements for its operation—a semi-hard magnetic element 16 and a soft magnetic element 18. The semi-hard magnetic element 16 is constituted by the thin magnetic strip of the present invention. The soft magnetic element 18 is any of the various soft magnetic materials known by those skilled in the art to be useful in EAS markers, such as those materials set forth in U.S. Pat. Nos. 4,510,489 and 5,351,033. The soft magnetic material generally has a coercivity of less than about 5 Oersteds, commonly less than about 2 Oersteds, and more advantageously less than about 1 Oersteds. Suitable materials include iron or cobalt alloys that contain various amounts of nickel, chromium, molybdenum, boron, phosphorus, silicon, carbon, and mixtures thereof; these alloys typically being amorphous. Typically, the semi-hard magnetic element 16 is used to activate and deactivate the marker 14.

The EAS system 10 generally further includes a transmitter 22 that transmits an AC magnetic field into the detection zone 20. The presence of the article 12, including the marker 14, in the zone 20 is detected by the receiver 24 that detects a signal generated by the interaction of the soft magnetic element 18 of the marker 14 with the transmitted magnetic field.

By placing the semi-hard magnetic element 16 in a magnetized state, the soft magnetic element 18 of the marker 14 can be enabled and placed in an activated state so that it interacts with the applied field to generate a signal. By changing the magnetized state of the semi-hard magnetic element 16 to a demagnetized state, the soft magnetic element 18 is disabled and placed in a deactivated state so that the marker 14 will not interact with an applied magnetic field to generate a signal. In this way, the marker 14 can be activated and deactivated as desired within a conventional activation/deactivation system (not shown), as is well known in the art.

EXAMPLE 1

Various thin strips were prepared having superior magnetic properties in accordance with the methods of the present invention while working with an iron-based alloy containing about 12.9 percent by weight Mn, about 0.01 percent by weight Cr, and the balance Fe. This iron-based alloy was melted by combining electrolytic iron and electrolytic manganese in a vacuum induction furnace using conventional techniques. An ingot weighing approximately 12 pounds was obtained, and this ingot was subsequently open die forged, starting at approximately 2,150° F. The final shape of the ingot was a plate roughly 0.5 inches thick, 5 inches wide, and 24 inches long. This plate was ground flat on both sides and on the edges in preparation for subsequent cold rolling. The plate thickness following the grinding was 0.275 inches. The plate was annealed at 1725° F. for one hour and then quenched in a helium gas. This plate was than cold rolled to 0.04 inches on a two-high cold rolling mill. The rolled plate was then annealed at 1725° F. for one hour and then quenched in a helium gas. The material was then rolled on a four-high cold rolling mill to 0.020 inches corresponding to an area reduction of 50 percent. This material was coiled and heat treated in a batch furnace for 16 hours at 842° F. The coil was subsequently rolled to 0.008 inches on the four-high cold rolling mill, and then transferred to a cluster-type foil mill and rolled to 0.002 inches, corresponding to a 90 percent area reduction. Between the rolling operations, the edges of the material were trimmed to prevent edge cracking.

The thus prepared strip material was then subjected to various final heat treatments within a strip annealing furnace. The various temperatures of the hot zone within the strip annealing furnace for the various runs are set forth in Table 1.1 along with the residence time (minutes) of the material within the hot zone. The final thickness of the strip, and the final magnetic properties of the strip, the coercivity and remanence, are set forth in Table 1.1.

TABLE 1.1

| Run | Thickness (mils) | Temperature (°F.) | Residence Time (Min.) | Hc (Oersteds) | Br (KG) |
|---|---|---|---|---|---|
| 1 | 2.05 | 800 | 2 | 43.6 | 11.5 |
| 2 | 2.05 | 800 | 1 | 42.5 | 11.45 |
| 3 | 2.05 | 800 | 0.33 | 42.2 | 10.9 |
| 4 | 2 | 1000 | 2 | 60.6 | 10.1 |
| 5 | 2 | 1000 | 2 | 60.9 | 10.2 |
| 6 | 2 | 1000 | 1 | 59.9 | 10.9 |
| 7 | 2 | 1000 | 1 | 59.9 | 10.9 |
| 8 | 2 | 1000 | 0.5 | 52.8 | 11.8 |
| 9 | 2 | 1000 | 0.33 | 45.9 | 11.8 |
| 10 | 2 | 1000 | 0.33 | 47.1 | 11.7 |
| 11 | 2 | 1100 | 1 | 69.1 | 8.0 |
| 12 | 2 | 1100 | 0.5 | 50.8 | 11.4 |
| 13 | 2 | 1100 | 0.33 | 47.4 | 11.3 |

What is claimed is:

1. A method for producing a thin magnetic strip that is readily slit and that exhibits superior magnetic properties, comprising:

(a) providing an iron-based alloy comprising at least about 80 weight percent iron and from about 8 to about 18 weight percent manganese, wherein the iron and manganese content is at least about 90 weight percent of said iron-based alloy;

(b) annealing said iron-based alloy by heating said iron-based alloy to a temperature of at least about 800° C.;

(c) cold rolling said iron-based alloy to reduce its thickness by at least 40 percent and to form a first strip;

(d) thermally treating said first strip at a temperature above about 400° C. and below the austenitizing temperature of the iron-based alloy for at least about 30 minutes;

(e) cold rolling said first strip to reduce its thickness by at least 75 percent and to form a second strip; and (f) thermally treating said second strip at a temperature of at least about 525° C. for a period of time less than about 3 minutes, wherein, after said thermal treatment, the coercivity of said second strip is at least about 20 Oersteds and the remanence of said second strip is at least about 8000 gauss, and said second strip having a thickness below 0.005 inches.

2. The method of claim 1 wherein the thermal treatment of said second strip is conducted at a temperature of between about 525° C. and about 600° C. for a period of time of from about 0.1 minutes to about 3 minutes.

3. The method of claim 2 wherein after the thermal treatment the coercivity of said second strip is at least 40 Oersteds and the remanence of said second strip is at least about 10,000 gauss.

4. The method of claim 3 wherein the iron-based alloy has a manganese content of from about 12 to about 15 percent by weight.

5. The method of claim 2 wherein after the thermal treatment the coercivity of said second strip is between about 20 and about 40 Oersteds and the remanence of said second strip is at least about 10,000 gauss.

6. The method of claim 5 wherein the iron-based alloy has a manganese content of from about 8 to about 12 percent by weight.

7. A method for producing a thin magnetic strip that is readily slit and that exhibits superior magnetic properties, comprising:

(a) providing an iron-based alloy comprising at least about 80 weight percent iron and from about 8 to about 18 weight percent manganese, wherein the iron and manganese content is at least about 95 weight percent of said iron-based alloy, said iron-based alloy being in the form of a strip having a thickness of less than about 0.05 inches;

(b) annealing said iron-based alloy by heating said iron-based alloy to a temperature of at least about 850° C.;

(c) cold rolling said iron-based alloy to reduce its thickness by at least 40 percent and to form a first strip;

(d) thermally treating said first strip at a temperature above about 400° C. and below the austenitizing temperature of the iron-based alloy for at least about 30 minutes;

(e) cold rolling said first strip to reduce its thickness by at least 85 percent and to form a second strip; and (f) thermally treating said second strip within a strip furnace by transporting said second strip through a hot zone within said strip furnace, said hot zone maintained at a temperature of at least about 525° C., wherein the residence time of the second strip within the hot zone is less than about 3 minutes;

whereby, after said thermal treatment, the coercivity of said second strip is at least about 20 Oersteds and the remanence of said second strip is at least about 8000 gauss, and said second strip having a thickness of less than 0.005 inches.

8. The method of claim 7 wherein the hot zone of said strip furnace is maintained at a temperature of between about 525° C. and about 600° C. and the residence time of the second strip through the hot zone is for a period of time of from about 0.1 minutes to about 3 minutes.

9. The method of claim 8 wherein after the thermal treatment the coercivity of said second strip is at least 40 Oersteds and the remanence of said second strip is at least about 10,000 gauss.

10. The method of claim 9 wherein the iron-based alloy has a manganese content of from about 12 to about 15 percent by weight.

11. The method of claim 8 wherein after the thermal treatment the coercivity of said second strip is between about 20 and about 40 Oersteds and the remanence of said second strip is at least about 10,000 gauss.

12. The method of claim 11 wherein the iron-based alloy has a manganese content of from about 8 to about 12 percent by weight.

* * * * *